US007968475B2

(12) United States Patent
Carbajal

(10) Patent No.: US 7,968,475 B2
(45) **Date of Patent: *Jun. 28, 2011**

(54) FABRIC ASSEMBLY SUITABLE FOR RESISTING BALLISTIC OBJECTS AND METHOD OF MANUFACTURE

(75) Inventor: Leopoldo Alejandro Carbajal, Newark, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 158 days.

This patent is subject to a terminal disclaimer.

(21) Appl. No.: 12/369,227

(22) Filed: Feb. 11, 2009

(65) Prior Publication Data

US 2010/0203304 A1 Aug. 12, 2010

Related U.S. Application Data

(63) Continuation-in-part of application No. 12/368,539, filed on Feb. 10, 2009, now abandoned.

(51) Int. Cl.
*B32B 27/04* (2006.01)

(52) U.S. Cl. ..... 442/134; 2/2.5; 428/105; 442/135

(58) Field of Classification Search ..... 2/2.5; 89/36.02, 89/36.03, 36.04, 36.05; 442/134, 135, 64, 442/65, 366, 381, 389, 286, 394; 428/102, 428/103, 104, 105, 113, 911, 902, 912
See application file for complete search history.

(56) References Cited

U.S. PATENT DOCUMENTS

| | | | |
|---|---|---|---|
| 3,562,810 | A | 2/1971 | Davis |
| 3,971,072 | A | 7/1976 | Armellino |
| 4,989,266 | A | 2/1991 | Borgese et al. |
| 5,185,195 | A | 2/1993 | Harpell et al. |
| 5,395,671 | A | 3/1995 | Coppage, Jr. et al. |
| 5,512,348 | A | 4/1996 | Mazelsky |
| 5,619,748 | A | 4/1997 | Nelson et al. |
| 2006/0286880 | A1 | 12/2006 | Termonia |
| 2008/0075933 | A1 | 3/2008 | Rovers |

FOREIGN PATENT DOCUMENTS

| | | | |
|---|---|---|---|
| DE | 203 14 504 | U1 | 12/2003 |
| EP | 1716770 | A2 | 11/2006 |

OTHER PUBLICATIONS

Structural and Stress Analysis (2nd Edition); Stress and Strain; Megson Elsvier; pp. 150-152; 2005.*

Techinical Note; The Performance of Quilted Body Armour Systems Under Ballistic Impact by Right Circular Cylinders; by Steven Niemi and Philip Cunniff; Jul. 1991.*

Steven R. Niemi and Philip Cunniff, The Performance of Quilted Body Armour Systems Under Ballistic Impact by Right Circular Cylinders, Jul. 1991, U.S. Army Natick Research, Development and Engineering Center, Technical Note: Natick/TN-91/0004.

(Continued)

*Primary Examiner* — Arti Singh-Pandey

(57) ABSTRACT

A fabric assembly particularly useful as soft body armor has two separate sections each containing a number of fabrics made from yarns having a tenacity of at least 7.3 grams per dtex and a modulus of at least 100 grams per dtex. Compressed fabrics in the first section are employed and connected by a connector having a force to break in tension not greater than 65N to form delineated areas in a range from 15 square mm to 350 square mm. Fabrics in the second section are not compressed and are not joined other than to prevent slippage of the fabrics relative to one another.

6 Claims, 4 Drawing Sheets

OTHER PUBLICATIONS

Tae Jin Kang and Sung Ho Lee, Effect of Stiching on the Mechanical and Impact Properties of Woven Laminate Composite, Journal of Composite Materials, vol. 28, No. 16/1994, Revised Jan. 15, 1994.

W.B. Black and J. Preston, Fiber-Forming Aromatic Polyamides, Man-Made Fibres-Science and Technology, vol. 2, p. 297, Interscience Publishers, 1968. Chemstrand Research Center, Inc. Durham, North Carolina.

* cited by examiner

FABRIC ASSEMBLY SUITABLE FOR RESISTING BALLISTIC OBJECTS AND METHOD OF MANUFACTURE

RELATED APPLICATION

The present patent application is a continuation-in-part of Ser. No. 12/368,539 filed Feb. 10, 2009.

BACKGROUND OF INVENTION

1. Field of the Invention

This invention relates to a fabric assembly particularly suitable as ballistic resistant soft body armor and method of manufacture.

2. Description of the Related Art

Many designs for body armor for resisting ballistic threats have been proposed and many commercialized. Designs are made to increase comfort by the wearer and/or to add extra penetration resistance without increasing areal density. Comfort is generally increased by making the body armor lighter and more flexible to allow freedom of motion by the wearer. However, reduction in apparel weight should not be achieved at the expense of a significant reduction in anti-ballistic performance.

US 2008/0075933 A1 discloses a ballistic-resistant assembly containing flexible elements of high strength fibres having connecting means on a rear part side of the assembly to interconnect adjacent elements. Such assemblies are claimed to reduce trauma (back face deformation) during a ballistic event.

Niemi and Cuniff in Technical Note Natick/TN-91/0004 with a title "The Performance of Quilted Body Armor Systems Under Ballistic Impact by Right Circular Cylinders" state that "Based on results obtained with 1.1 gram right circular cylinders, the effect of quilting resulted in little or no increase in the calculated ballistic limit values or specific energy absorption capacity of the Kevlar®, Spectra® and nylon armor systems evaluated".

There is a need for a light weight soft body armor which allows an increase in ballistic resistance without an increase in weight.

SUMMARY OF THE INVENTION

The present invention is directed to a fabric assembly suitable for resisting a ballistic object and method of manufacture with the fabric assembly comprising:

(a) a first section comprising a plurality of connected and compacted fabric layers made from yarn having a tenacity of at least 7.3 grams per dtex and a modulus of at least 100 grams per dtex, wherein the connected and compacted fabric layers are secured together by connectors having a mechanical strength not greater than 65 N, wherein said connectors define areas within and on surfaces of the plurality of fabric layers in a range from 15 to 350 square mm. and wherein compaction of the fabric layers of the first section is at least 2% as set forth in Test Method A and (b) a second section comprising a plurality of fabric layers made from yarn having a tenacity of at least 7.3 grams per dtex and a modulus of at least 100 grams per dtex wherein the fabric layers are not connected to define areas in a range from 15 to 350 square mm. and wherein compaction of the fabric layers of the second section is not greater than 0.5% as set forth in Test Method A.

DETAILED DESCRIPTION

Figure 1A:
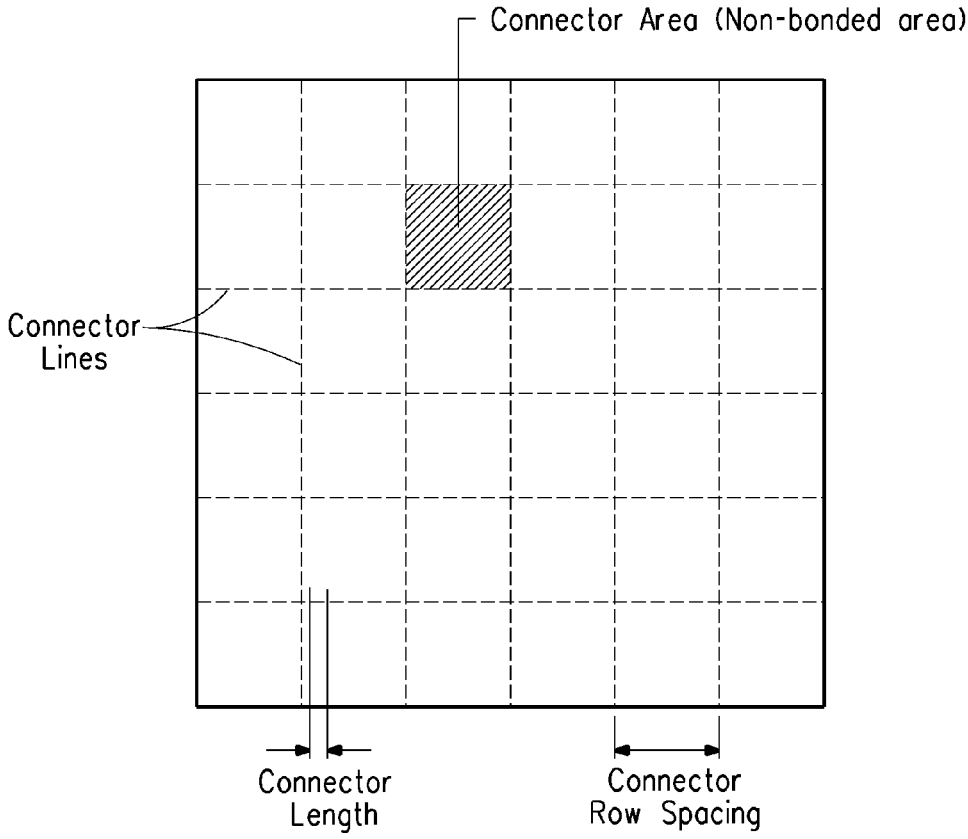
FIG. 1A is a plan view of the outer fabric layers (plies) of the first section and explains connector lines, connector length, connector row spacing and connector area.

The fabric assembly suitable for resisting a ballistic object contains two separate and distinct sections labeled herein as a first section and a second section. Both sections contain a plurality of fabric layers made from yarns having a tenacity of at least 7.3 grams per dtex and a modulus of at least 100 grams per dtex.

As employed herein "plurality" means at least two. However in many instances at least five and sometimes at least ten or up to thirty fabric layers will be employed in the first and/or second sections of the fabric assembly.

Yarns in First and Second Sections of Fabric Assembly

Yarns having a tenacity of at least 7.3 grams per dtex and a modulus of at least 100 grams per dtex which are employed in the first and second sections are well known in the art. It is understood that the yarns in the first and second sections need not be identical. Suitable materials for the yarn include polyamide, polyolefin, polyazole and mixtures thereof.

When the polymer is polyamide, aramid is preferred. The term "aramid" means a polyamide wherein at least 85% of the amide (—CONH—) linkages are attached directly to two aromatic rings. Suitable aramid fibers are described in Man-Made Fibres—Science and Technology, Volume 2, Section titled Fibre-Forming Aromatic Polyamides, page 297, W. Black et al., Interscience Publishers, 1968.

A preferred aramid is a para-aramid. A preferred para-aramid is poly(p-phenylene terephthalamide) which is called PPD-T. By PPD-T is meant a homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride or 3,4'-diaminodiphenylether.

Additives can be used with the aramid and it has been found that up to as much as 10 percent or more, by weight, of other polymeric material can be blended with the aramid. Copolymers can be used having as much as 10 percent or more of other diamine substituted for the diamine of the aramid or as much as 10 percent or more of other diacid chloride substituted for the diacid chloride or the aramid.

When the polymer is polyolefin, polyethylene or polypropylene is preferred. The term "polyethylene" means a predominantly linear polyethylene material of preferably more than one million molecular weight that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, propylene, and the like, or low molecular weight additives such as anti-oxidants, lubricants, ultra-violet screening agents, colorants and the like which are commonly incorporated. Such is commonly known as extended chain polyethylene (ECPE) or ultra high molecular weight polyethylene (UHMWPE In some preferred embodiments polyazoles are polyarenazoles such as polybenzazoles and polypyridazoles. Suitable polyazoles include homopolymers and, also, copolymers. Additives can be used with the polyazoles and up to as much as 10 percent, by weight, of other polymeric material can be blended with the polyazoles. Also copolymers can be used having as much as 10 percent or more of other monomer substituted for a monomer of the polyazoles. Suitable polyazole homopolymers and copolymers can be made by known procedures.

Preferred polybenzazoles are polybenzimidazoles, polybenzothiazoles, and polybenzoxazoles and more preferably such polymers that can form fibers having yarn tenacities of 30 gpd or greater. If the polybenzazole is a polybenzothioazole, preferably it is poly(p-phenylene benzobisthiazole). If the polybenzazole is a polybenzoxazole, preferably it is poly (p-phenylene benzobisoxazole) and more preferably poly(p-phenylene-2,6-benzobisoxazole) called PBO.

Preferred polypyridazoles are polypyridimidazoles, polypyridothiazoles, and polypyridoxazoles and more preferably such polymers that can form fibers having yarn tenacities of 30 gpd or greater. In some embodiments, the preferred polypyridazole is a polypyridobisazole. A preferred poly(pyridobisozazole) is poly(1,4-(2,5-dihydroxy)phenylene-2,6-pyrido[2,3-d:5,6-d']bisimidazole which is called PIPD. Suitable polypyridazoles, including polypyridobisazoles, can be made by known procedures.

First Section of Fabric Assembly

The requirements of the yarn in the fabrics of the first section of the fabric assembly have been set forth above.

Further requirements of the first section include fabrics which (1) are connected to one another (2) are compacted, (3) are secured together by connectors having a mechanical strength (force to break in tension) not greater than 65 N, (4) have areas in a range from 15 square mm to 350 square mm defined by the connectors and (5) have compaction of at least 2% as set forth in Test Method A.

Requirements (1), (3) and (4) are discussed in conjunction with one another.

It is necessary that the fabrics of the first section be physically attached to one another. The attachment of the fabric layers is by connectors having a mechanical strength not greater than 65 N. Preferably the mechanical strength will not be greater than 40N and more preferably 35N. The lower limit for a mechanical strength is not critical but as a practical matter will not be less than 1 N The force to break in tension of the connector is the multiplier of the ultimate tensile stress of the connector material, or materials, and the cross sectional area of the connector. Thus the dimensions of the connector can be tailored to achieve the desired force to break for a particular material. For chemical connectors the desired dimension is the area of adhesion between two adjacent fabric layers.

A preferred connector is through the use of thread for stitching, i.e. the separate fabric layers of the first section are stitched together. The thread may be a continuous filament yarn or a staple fiber. In machine stitching, it is common to loop two threads together one thread being fed from the top side and the other being fed from the bottom side. When such a stitching technique is being used to sew connector threads then at least one of the bobbins must be of a material having a force to break no greater than 65N. If a plied yarn is used as a connector thread, then the combined force to break of the individual threads comprising the yarn must be no greater than 65N. A plied yarn is a yarn formed by twisting together two or more singles yarns. Suitable thread materials include aramid, cotton, nylon, polyester or elastomeric polyurethane (Lycra®). A connector yarn that shrinks when heated is an alternative means to compact fabric layers.

However it is understood that connectors other than stitching thread or yarn may be employed These connectors can be mechanical such as by stapling or by chemical means. It is understood that the connectors need not contact one another provide the area delineated by the connectors.

Mechanical connectors can be in many forms not only by thread but also by clips, pins, needles or staples and made of polymeric, metal, ceramic or other inorganic material. For pins, clips, needles or staples suitable materials include carbon, glass, ceramic, metal or polymer.

An example of a chemical connector is an adhesive. It is preferable that the adhesive has a modulus no greater than 1379 MPa. The adhesive may be thermoset or thermoplastic preferably curing between 20° C. to 180° C. and more preferably between 20° C. to 120° C. The adhesive may be in the form of a liquid, paste, powder or film. Suitable materials include epoxy, phenolic, urethane, polyester, vinyl ester, polyimide or maleimide. The adhesive connectors may take the form of continuous or broken lines, dots, ovals, diamonds and other shapes.

As set forth above, a connector is required to have a force to break in tension not greater than 65 N. In the case of a mechanical connector the force to break can be determined by testing the connector prior to use. However for a chemical connector, typically it is necessary to determine the mechanical strength in actual use with layers of fabric.

Figure 1B:
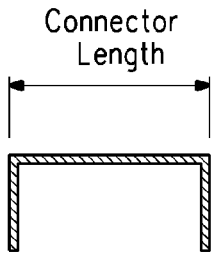
FIG. 1B is an end view of a staple or clip connector.
Figure 1C:
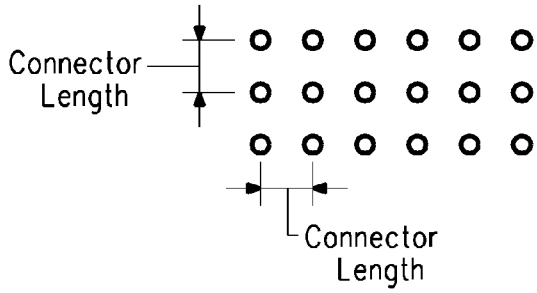
FIG. 1C is a plan view showing a pin pattern of connectors through fabric plies.

Connector pitch length is (1) for stitches, the minimum distance that the needle advances along a connector line on the surface of the fabric in making one stitch, (2) for clips and staples, the length of the clip or staple and (3) for pins, the minimum distance between two adjacent connectors on the same connector line. This is further detailed in FIGS. 1A to 1C.

Connector area is the area enclosed by a boundary of connector lines.

Connector row spacing is the distance between adjacent parallel connector lines.

The function of the connector is to enhance the momentum transfer capability of the armor without impacting the mechanical properties of the high tenacity filaments in the fabric. Another requirement is not to over-constrain the axial movement of the filaments in the fabric.

To enhance the momentum transfer, the connectors need to be able to compact the fabric layers in the region where the connector lies on the fabric surface. The connectors also define areas on a surface and within each of the connected fabrics of the first section of the fabric assembly The surface areas are in a range from 15 to 350 square mm, a preferred range is 100 to 250 square mm and a more preferred range is 115 to 180 square mm. The number of defined areas in the first section of the fabric assembly will be determined by the overall size of the fabric assembly. Since a preferred use of the assembly is as soft body armor to be worn by a person an example of a minimum number of areas defined by connectors on a surface of a fabric assembly will be at least 1000.

The connector may be of any suitable length. Preferably the length is from 2.54 to 15.24 mm and more preferably from 3.56 to 14.22 mm. For adhesive dots, ovals and the like, the length is the maximum dimension of the adhesive dot or oval. The area enclosed by the connectors is more important than the area shape. Suitable area shapes defined by connector lines include, but are not limited to, squares, rectangles, triangles, hexagons, diamonds and chevrons. For practical reasons, connector areas below 15 sq. mm. are less desirable due to the risk of yarn damage from the connector insertion process.

Techniques for inserting connectors are well known and include sewing, for thread, and pressure guns, ultrasonics and the like for pins, needles and staples. All these techniques are well known in the textile art.

When connectors are of the sewn type, the type of stitches employed is not critical and may vary widely provided that the required relationships for pitch length and row spacing are followed. Stitching and sewing methods such as hand stitching, multi-thread chain stitching, over edge stitching, flat seam stitching, single thread lock stitching, lock stitching, chain stitching, zig-zag stitching and the like constitute the preferred securing means for use in this invention.

In order to minimize damage to the yarns of the fabric layers, and hence ballistic resistance, it is preferable that the connector lines are positioned in a direction such that they form an angle of between five and eighty five degrees with both the warp and weft yarns of the fabric. More preferably this angle should be between twenty and seventy degrees.

A further requirement of the first section of the fabric assembly is use of fabrics which are compacted and have compaction of at least 2% as set forth in Test Method A. This test defines a procedure wherein the thickness of a fabric is first measured after manufacture and without further handling to decrease the fabric thickness. The thickness of a fabric is then measured after compaction for use in the first section of the fabric assembly. The compaction expressed on a % basis is the amount of decrease of fabric thickness based on the original fabric thickness.

The compacted fabrics for the first section of the fabric assembly will have a compaction of at least 2%, preferably at least 5% and more preferably at least 7%. For purposes of illustration the compaction will not be greater than 20% with a narrower maximum of 15%.

Second Section of Fabric Assembly

The requirements of the yarn in the fabrics of the second section of the fabric assembly have been set forth above. The fibers of the second section may be different from those of the first section.

Further requirements of the second section include (1) the fabrics are not connected to define areas in a range from 15 to 350 square mm and (2) compaction of the fabrics is not greater than 0.5% as set forth in test method A. These essentially non-compacted fabrics are also known in the art as loose plies.

Figure 2:
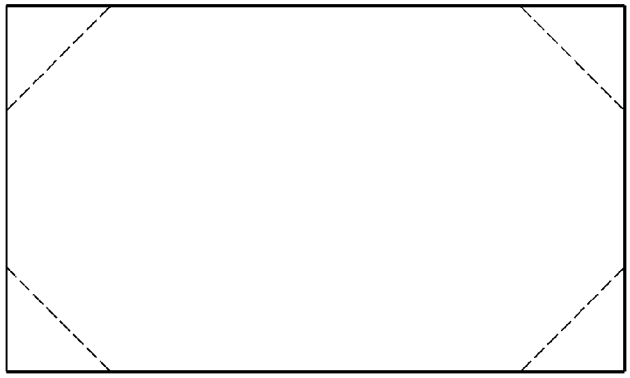
FIG. 2 is a plan view of fabric layers of the second section without connectors and held together by corner tack stitching.
Figure 3A:
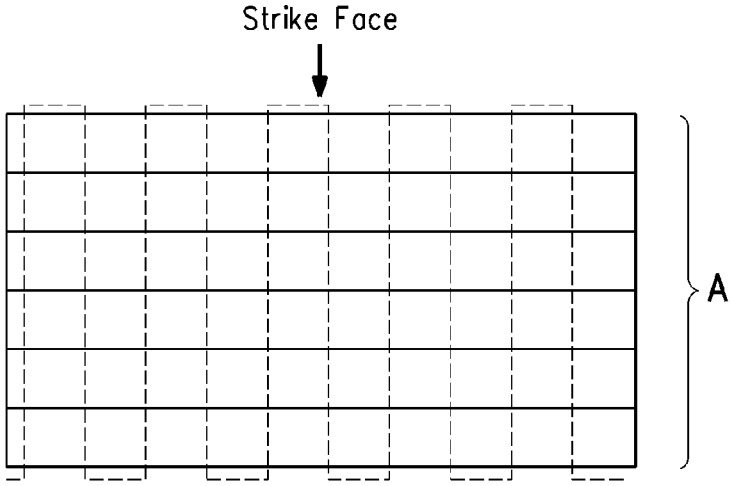
FIG. 3A is a sectional view of a plurality of fabric layers of the first section having connectors. This is referenced as "A".
Figure 3B:
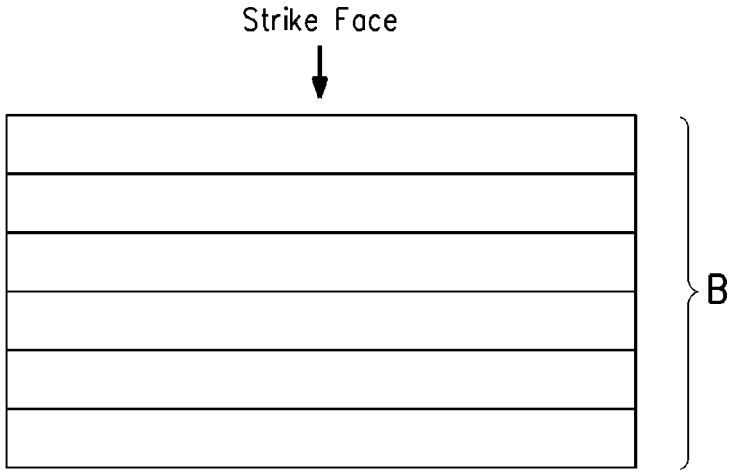
FIG. 3B is a sectional view of a plurality of fabric layers of the second section having no connectors. This is referenced as "B".

For requirement (1) of the second section of the fabric assembly, it is preferred that the fabric layers are not connected to one another. However it is understood that in manufacture of the overall fabric assembly it may be advisable to keep the layers aligned without slipping. Therefore, as employed herein, "substantially no connection" means that the amount of connection is an amount needed to prevent slipping but insufficient to force the layers to compact one another. An example of this is corner stitching as depicted in FIG. 2. Accordingly the second section preferably has substantially no connection between and among (if more than two) fabrics. For requirement (2) of the second section of the fabric assembly, it is preferred the there is no compaction of the fabrics. However in normal handling and in manufacture a minimum compaction can occur. Therefore a maximum compaction as set forth in Test Method A is not greater than 0.5%, preferably 0.2% and more preferably 0%.

Construction of Fabrics

It is understood that a wide variety of construction techniques may be used for the fabrics of the first and second sections of the fabric assembly. Illustratively the fabrics may be woven, may be unidirectional with or without binder, may be multiaxial with layers of yarn in different orientation or may be three dimensional. Each of these fabric styles is well known in the art. It is further understood that different combinations of fabrics both in construction and composition can be employed in the first section and in the second section of the fabric assembly.

Body Armor Article

The body armor article comprises at least two fabric layer sub-assemblies, one sub-assembly comprising fabric layers having connectors, the first section, and the other comprising fabric layers without connectors, the second section. Each sub-assembly can have from two to thirty woven fabric layers stacked together. The woven fabric layers in the different sub-assemblies can be the same or different. A final assembly comprises at least one type of each sub-assembly. The final assembly is then fitted into a vest pack or body armor article.

The total number of fabric layers from all of the sub-assemblies comprising the final assembly, when stacked together, should preferably have an areal density no greater than 5.0 $kg/m^2$ and preferably no greater than 4.68 $kg/m^2$.

Depending on the ballistic vest design, the number of fabric layers requiring connectors will vary. The location of layers having connectors and those not having connectors can vary within the assembly e.g. see FIGS. 4, 4A, 5, 6A and 6B. In these figures, a fabric layer identified with an "A" has connectors and those identified by a "B" has no connectors. Combinations of sub-assemblies other than those described in the drawings are also useful.

Figure 4:
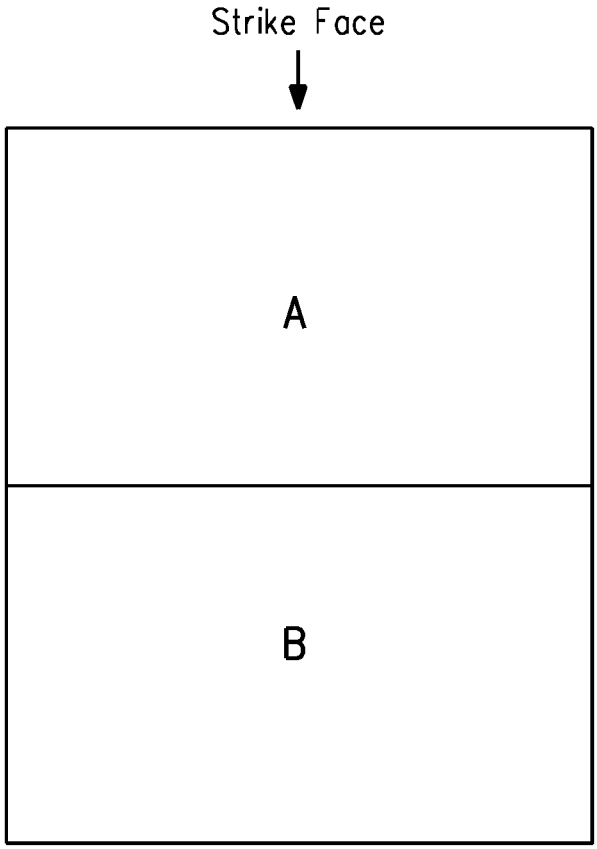
FIG. 4 is a sectional view of a vest stack having a first section per A of FIG. 3A as a strike face and a second section per B of FIG. 3B as a back face.
Figure 4A:
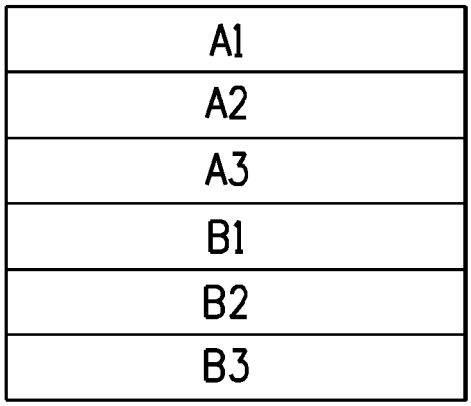
FIG. 4A is a sectional view of a vest stack assembled from a number of sub-assemblies of fabric layers A at the strike face and a number of sub-assemblies of fabric layers B at the back face.

In a first embodiment as shown in FIG. 4, a sub-assembly "A" comprising fabric layers having connectors is facing the strike direction while a sub-assembly "B" comprising fabric layers without connectors is facing the non-strike direction.

In a second embodiment, a number of sub-assemblies each comprising fabric layers having connectors is facing the strike direction while a number of sub-assemblies each comprising layers without connectors is facing the non-strike direction. This is exemplified by FIG. 4A which shows three sub-assemblies of fabric layers with connectors, A1, A2 and A3, facing the projectile and three sub-assemblies of fabric layers without connectors, B1, B2 and B3, facing the non-strike direction.

Figure 5:
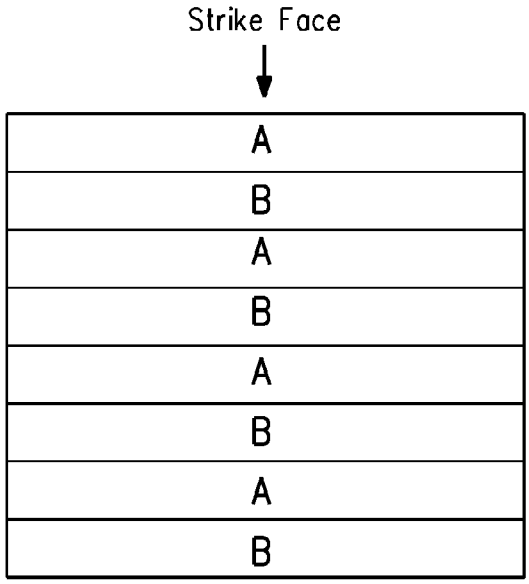
FIG. 5 is a sectional view of a vest stack having a repeat sequence of A and B.
Figure 6A:
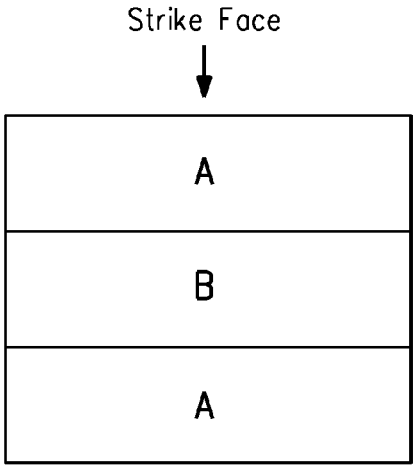
FIG. 6A is a sectional view of a vest stack having first sections per A of FIG. 3A as a strike face and a back face sandwiching a core having a second section per B of FIG. 3B.
Figure 6B:
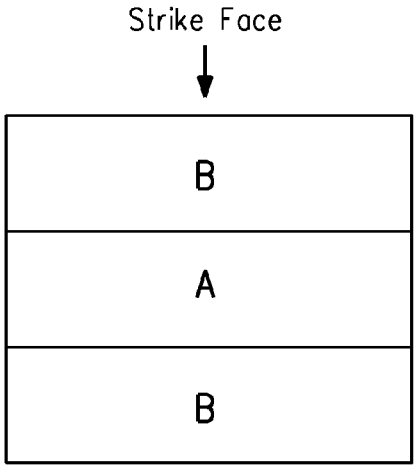
FIG. 6B is a sectional view of a vest stack having second sections per B of FIG. 3B as a strike face and back face sandwiching a core having a first section per A of FIG. 3A.

A third embodiment, as in FIG. 5, covers an arrangement of alternating sub-assemblies of fabric layers having connectors "A" and fabric layers without connectors "B".

In a fourth embodiment, two sub-assemblies each comprising fabric layers having connectors form the two outer layers of the final assembly with a sub-assembly comprising fabric layers without connectors forming the core of the assembly. This is demonstrated in FIG. 6A.

In a fifth embodiment, two sub-assemblies each comprising fabric layers without connectors form the two outer layers of the final assembly with a sub-assembly comprising fabric layers having connectors forming the core of the assembly. This is demonstrated in FIG. 6B.

The fabric layers of the sections without connectors must be held together to maintain a certain level of coherence. These layers can, for example, be attached by stitches or adhesive or melt bonding at the edges and/or across the corners of the fabric. These stitches in the fabric layers do not compact the layers in the same way as do the connectors and have no influence on anti-ballistic performance. Any suitable thread may be used for sewing at the edges and corners. Aramid thread is particularly suitable for edge and corner stitching. Edge or corner stitching is an optional process for the fabric layers having connectors, the benefit being that it may aid the final assembly process.

Preferably, the ballistic resistant fabric final assembly has a V50 of at least 465 m/sec when tested against a 9 mm projectile and/or V50 of at least 579 m/sec when tested against a 17 grain projectile and the fabric layers, when stacked together, have a stack areal density not exceeding 4.68 kg/m$^2$. V50 is a statistical measure that identifies the average velocity at which a bullet or a fragment penetrates the armor equipment in 50% of the shots, versus non penetration of the other 50%. The parameter measured is V50 at zero degrees where the degree angle refers to the obliquity of the projectile to the target.

Method of Assembly

A process for making a fabric assembly for a soft body armor article comprises the steps of (1) forming an assembly or sub-assemblies of fabric layers comprising connectors having a force to break of no greater than 65N such that the area enclosed by the connectors is from 30 to 350 sq. mm (2) forming an assembly or sub-assemblies of fabric layers having no connectors and stitching these layers along the edges and/or across the corners (3) combining the assemblies or sub-assemblies in the desired sequence such that the total weight of all fabric layers is less than 5.0 kg/m$^2$ and more preferably less than 4.68 kg/m$^2$ and (4) placing the final fabric assembly in a pouch or vest pack.

TEST METHODS

Temperature: All temperatures were measured in degrees Celsius (° C.).

Linear Density The linear density of a yarn or fiber is determined by weighing a known length of the yarn or fiber based on the procedures described in ASTM D1907-97 and D885-98. Decitex or "dtex" is defined as the weight, in grams, of 10,000 meters of the yarn or fiber. Denier (d) is 9/10 times the decitex (dtex).

Tensile Properties: The fibers to be tested were conditioned and then tensile tested based on the procedures described in ASTM D885-98. Tenacity (breaking tenacity), modulus of elasticity, force to break and elongation to break are determined by breaking test fibers on an Instron universal test machine.

Areal Density: The areal density of the fabric layer was determined by measuring the weight of each single layer of selected size, e.g., 10 cm×10 cm. The areal density of a composite structure was determined by the sum of the areal densities of the individual layers.

Ballistic Penetration Performance: Ballistic tests of the multi-layer panels were conducted in accordance with standard procedures such as those described in procurement document FQ/PD 07-05B (Body Armor, Multiple Threat/Interceptor Improved Outer Tactical Vest) and MIL STD-662F (V50 Ballistic Test for Armor). Four targets were tested for most examples and between six to nine shots, at zero degree obliquity, fired at each dry target. The reported V50 values are average values for the number of shots fired for each example.

EXAMPLES

Examples prepared according to the process or processes of the current invention are indicated by numerical values. Control or Comparative Examples are indicated by letters. Data and test results relating to the Comparative and Inventive Examples are shown in Table 1.

Description of Layers

Layers of the following high tenacity fiber fabrics and sheet structures were prepared and made into various composite assemblies for ballistic test as follows.

(S15351F) Fabric layer "F1" was a plain weave woven fabric of 600 denier (660 dtex) poly(p-phenylene terephthalamide) (or PA) yarn available from E. I. du Pont de Nemours and Company under the trade name of Kevlar® para-aramid brand KM2 yarn and was woven at 11.1×11.1 ends per centimeter (28×28 ends per inch).

(S706F) Fabric layer "F2" was a plain weave woven fabric of 600 denier (660 dtex) poly(p-pheynlene terephthalamide) (or PA) yarn available from E. I. du Pont de Nemours and Company under the trade name of Kevlar® para-aramid brand KM2 yarn and was woven at 13.5×13.5 ends per centimeter (34×34 ends per inch).

The above fabric layers were assembled as per the following examples and then, prior to shooting, were placed in a nylon bag of about 38 cm×38 cm (15"×15"). The side of the bag facing the projectile was 900 dtex (1000 denier) Woodland Camouflage Cordura rip stop fabric and the other side was 450 dtex (500 denier) Black Cordura rip-stop fabric. Both fabrics were obtained from Bradford Printing & Finishing LLC, Bradford, R.I.

The connector threads were all sewn using a Juki sewing machine, model LU 563.

Example A

Twenty eight layers of fabric F2 of about 38 cm×38 cm (15"×15") were held together by stitches located at the four corners of the layers (corner stitch) into an article with an areal density of 5.23 kg/m$^2$. The corner stitching thread was 800 dtex (720 denier) Kevlar® under the tradename B-92 from Imperial Threads Inc., Northbrook, Ill. Ballistic tests were conducted using 9 mm 124 grain FMJ bullets against targets supported on a Roma Plastina number 1 clay backing medium. Results of the ballistic tests of four targets gave V50 values between 478 and 500 m/s with an average value of 488 m/s.

Example B

In this example, twenty six layers of fabric F2 of about 38 cm×38 cm (15"×15") were held together by stitches located at the four corners of the layers (corner stitch) into an article with an areal density of 4.88 kg/m$^2$. The corner stitching thread was 800 dtex (720 denier) Kevlar® under the tradename B-92 from Imperial Threads Inc. Ballistic tests were conducted using 9 mm 124 grain FMJ bullets against targets supported on a Roma Plastina number 1 clay backing medium. Results of the ballistic tests of four targets gave V50 values between 474 and 497 m/s with an average value of 483 m/s.

Example C

Thirty five layers of fabric layers F1 of about 38 cm×38 cm (15"×15") were held together by stitches located at the four corners of the layers (corner stitch) into an article with an areal density of 5.28 kg/m$^2$. The corner stitching thread was 800 dtex (720 denier) Kevlar® under the tradename B-92 from Imperial Threads Inc. Ballistic tests were conducted using 9 mm 124 grain FMJ bullets against targets supported on a Roma Plastina number 1 clay backing medium. Results of the ballistic tests of four targets gave V50 values between 496 and 525 m/s with an average value of 511 m/s.

Example D

Thirty one layers of fabric layers F1 of about 38 cm×38 cm (15"×15") were held together by stitches located at the four corners of the layers (corner stitch) into an article with an areal density of 4.68 kg/m$^2$. The corner stitching thread was 800 dtex (720 denier) Kevlar® under the tradename B-92 from Imperial Threads Inc. Ballistic tests were conducted using 9 mm 124 grain FMJ bullets against targets supported on a Roma Plastina number 1 clay backing medium. Results of the ballistic tests of four targets gave V50 values between 454 and 466 m/s with an average value of 462 m/s.

Example E

Twenty eight layers of fabric F2 of about 38 cm×38 cm (15"×15") were held together by stitches located at the four corners of the layers (corner stitch) into an article with an areal density of 5.23 kg/m$^2$. The corner stitching thread was 800 dtex (720 denier) Kevlar® under the tradename B-92 from Imperial Threads Inc. Ballistic tests were conducted using 17 grain fragment simulating projectiles (FSP's) against targets supported on an aluminum 24 ga, 0.20, 2024-T3 frame and clamp backing plate. Results of the ballistic tests of four targets gave V50 values between 563 and 612 m/s with an average value of 577 m/s.

Example F

Twenty six layers of fabric F2 of about 38 cm×38 cm (15"×15") were held together by stitches located at the four corners of the layers (corner stitch) into an article with an areal density of 4.88 kg/m$^2$. The corner stitching thread was 800 dtex (720 denier) Kevlar® under the tradename B-92 from Imperial Threads Inc. Ballistic tests were conducted using 17 grain FSP's against targets supported on an aluminum 24 ga, 0.20, 2024-T3 frame and clamp backing plate. Results of the ballistic tests of four targets gave V50 values between 532 and 582 m/s with an average value of 558 m/s.

Example G

Thirty five layers of fabric layers F1 of about 38 cm×38 cm (15"×15") were held together by stitches located at the four corners of the layers (corner stitch) into an article with an areal density of 5.28 kg/m$^2$. The corner stitching thread was 800 dtex (720 denier) Kevlar® under the tradename B-92 from Imperial Threads Inc. Ballistic tests were conducted using 17 grain FSP's against targets supported on an aluminum 24 ga, 0.20, 2024-T3 frame and clamp backing plate. Results of the ballistic tests of four targets gave V50 values between 573 and 606 m/s with an average value of 592 m/s.

Example H

Thirty one layers of fabric layers F1 of about 38 cm×38 cm (15"×15") were held together by stitches located at the four corners of the layers (corner stitch) into an article with an areal density of 4.68 kg/m$^2$. The corner stitching thread was 800 dtex (720 denier) Kevlar® under the tradename B-92 from Imperial Threads Inc. Ballistic tests were conducted using 17 grain FSP's against targets supported on an aluminum 24 ga, 0.20, 2024-T3 frame and clamp backing plate. Results of the ballistic tests of six targets gave V50 values between 553 and 578 m/s with an average value of 565 m/s.

Example J

In this example, thirteen layers of fabric F2 of about 38 cm×38 cm (15"×15") were held together by connectors sewn through and orthogonal to the thirteen layers. The connector material was 961 dtex (865 denier) Kevlar® spunthread from Saunders Thread Company, Gaston, N.C. having a force to break of 69.8N. The connector pitch length was 6.4 mm and the connector row spacing was 12.8 mm. The connector lines enclosed a connector area of 161 sq. mm. The sub-assembly with the connectors was then combined with 13 loose layers, 38 cm×38 cm (15"×15"), of fabric F2 by corner stitching into an article with an areal density of 4.88 kg/m$^2$. The corner stitching thread was 800 dtex (720 denier) Kevlar® under the tradename B-92 from Imperial Threads Inc. Ballistic tests were conducted using 17 grain fragment simulating projectiles (FSP's) against targets supported on an aluminum 24 ga, 0.20, 2024-T3 frame and clamp backing plate. The test articles were arranged in the tests such that the layers having the connectors were facing the projectile. Results of the ballistic tests of four targets gave V50 values between 521 and 562 m/s with an average value of 547 m/s.

Example K

In this example, fifteen layers of fabric F1 of about 38 cm×38 cm (15"×15") were held together by connectors sewn through and orthogonal to the fifteen layers. The connector material was 961 dtex (865 denier) Kevlar® spunthread from Saunders Thread Company having a force to break of 69.8N. The connector pitch length was 6.4 mm and the connector row spacing was 12.8 mm. The connector lines enclosed a connector area of 161 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 17 grain fragment simulating projectiles (FSP's) against targets supported on an aluminum 24 ga, 0.20, 2024-T3 frame and clamp backing plate. The test articles were arranged in the tests such that the layers having the connectors were facing the projectile. Results of the ballistic tests of four targets gave V50 values between 554 and 586 m/s with an average value of 571 m/s.

Example L

In this example, twenty six layers of fabric F2 of about 38 cm×38 cm (15"×15") were held together by connectors sewn through and orthogonal to all the layers. The connector material was 453 dtex (408 denier) cotton thread from United Mills having a force to break of 18.5N. The connector pitch length was 6.4 mm and the connector row spacing was 12.8 mm. The connector lines enclosed a connector area of 161 sq. mm. In addition, stitches were located at the four corners of the layers (corner stitch) giving an article with an areal density of 4.68 kg/m$^2$. The corner stitching thread was 800 dtex (720 denier) Kevlar® under the tradename B-92 from Imperial Threads Inc. Ballistic tests were conducted using 17 grain FSP's against targets supported on an aluminum 24 ga, 0.20, 2024-T3 frame and clamp backing plate. Results of the ballistic tests of four targets gave V50 values between 499 and 532 m/s with an average value of 518 m/s.

Example 1

In this example, thirteen layers of fabric F2 of about 38 cm×38 cm (15"×15") were held together by connectors sewn through, and orthogonal to, the thirteen layers. The connector material was 453 dtex (408 denier) cotton thread from United Thread Mills having a force to break of 18.5N. The connector pitch length was 6.4 mm and the connector row spacing was 12.8 mm. The connector lines enclosed a connector area of 161 sq. mm. The sub-assembly with the connectors was then combined with 13 loose layers, 38 cm×38 cm (15"×15"), of fabric F2 by corner stitching into an article with an areal density of 4.88 kg/m$^2$. The corner stitching thread was 800 dtex (720 denier) Kevlar® under the tradename B-92 from Imperial Threads Inc. Ballistic tests were conducted using 9 mm 124 grain FMJ bullets against targets supported on a Roma Plastina number 1 clay backing medium. The test articles were arranged in the tests such that the layers having the connectors were facing the projectile. Results of the ballistic tests of four targets gave V50 values between 484 and 493 m/s with an average value of 487 m/s.

Example B had had one firing where an abnormally high V50 value was observed thus giving a higher average value. However Example 1, having fabric layers with connectors in an assembly having a seven percent lower areal density than the control Example A did not exhibit any reduction in V50 when compared to Example A.

Example 2

In this example, fifteen layers of fabric F1 of about 38 cm×38 cm (15"×15") were held together by connectors sewn through, and orthogonal to, the fifteen layers. The connector material was 453 dtex (408 denier) cotton thread from United Thread Mills having a force to break of 18.5N. The connector pitch length was 6.4 mm and the connector row spacing was 12.8 mm. The connector lines enclosed a connector area of 161 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 9 mm 124 grain FMJ bullets against targets supported on a Roma Plastina number 1 clay backing medium. The test articles were arranged in the tests such that the layers having the connectors were facing the projectile. Results of the ballistic tests of four targets gave V50 values between 483 and 498 m/s with an average value of 492 m/s.

Comparison of results for examples C, D and 2 show that Example C having an article weight of 5.28 kg/m$^2$ had an acceptable V50 whereas Example D at a reduced areal density of 4.68 kg/m$^2$ had a V50 value ten percent lower and just below the desired target value. Example 2, having the same number of fabric layers and density as Example B but incorporating connectors at the strike face in the first fifteen layers of fabric restored the V50 performance by six percent to an acceptable value.

Example 3

In this example, thirteen layers of fabric F2 of about 38 cm×38 cm (15"×15") were held together by connectors sewn through, and orthogonal to, the thirteen layers. The connector material was 453 dtex (408 denier) cotton thread from United Thread Mills having a force to break of 18.5N. The connector pitch length was 6.4 mm and the connector row spacing was 12.8 mm. The connector lines enclosed a connector area of 161 sq. mm. The sub-assembly with the connectors was then combined with thirteen loose layers of fabric F2 of about 38 cm×38 cm (15"×15") by corner stitching into an article with an areal density of 4.88 kg/m$^2$. The corner stitching thread was 800 dtex (720 denier) Kevlar® under the tradename B-92 from Imperial Threads Inc. Ballistic tests were conducted using 17 grain FSPs against targets supported on an aluminum 24 ga, 0.20, 2024-T3 frame and clamp backing plate. The test articles were arranged such that the layers having the connectors were facing the projectile. Results of the ballistic tests of four targets gave V50 values between 552 and 575 m/s with an average value of 569 m/s.

Comparison of results for examples E, F and 3 show that reducing the areal density by seven percent brought about a four percent knockdown in V50 value. Incorporating connectors at the strike face in the first thirteen layers of fabric recovered all but one percent of V50 performance. Example L demonstrated that sewing connectors throughout all the fabric layers resulted in a very low V50 value. The use of connector material having a force to break above 65 N also gave a low V50 as exemplified by Example J.

Example 4

In this example, fifteen layers of fabric F1 of about 38 cm×38 cm (15"×15") were held together by connectors sewn through, and orthogonal to, the fifteen layers. The connector material was 453 dtex (408 denier) cotton thread from United Thread Mills having a force to break of 18.5N. The connector pitch length was 6.4 mm and the connector row spacing was 12.8 mm. The connector lines enclosed a connector area of 161 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 17 grain FSP's against targets supported on an aluminum 24 ga, 0.20, 2024-T3 frame and clamp backing plate. The test articles were arranged such that the layers having the connectors were facing the projectile. Results of the ballistic tests of four targets gave V50 values between 564 and 605 m/s with an average value of 585 m/s.

Comparison of results for examples G, H and 4 show that Example G having an article weight of 5.28 kg/m$^2$ had an acceptable V50 whereas Example H at a reduced areal density of 4.68 kg/m$^2$ had a V50 value five percent lower and below the desired target value. Example 4, having the same number of fabric layers and density as Example H but incorporating inventive connectors at the strike face in the first fifteen layers of fabric resulted in an almost a full recovery of V50 performance.

Example 5

In this example, fifteen layers of fabric F1 of about 38 cm×38 cm (15"×15") were held together by connectors sewn through, and orthogonal to, the fifteen layers. The connector material was 453 dtex (408 denier) cotton thread from United Thread Mills having a force to break of 18.5N. The connector pitch length was 6.4 mm and the connector row spacing was 19.1 mm. The connector lines enclosed a connector area of 363 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 17 grain fragment simulating projectiles (FSP's) against targets supported on an aluminum 24 ga, 0.20, 2024-T3 frame and clamp backing plate. The test articles were arranged in the tests such that the layers having the connectors were facing the projectile. Results of the ballistic tests of two targets gave V50 values of 558 and 570 m/s with an average value of 564 m/s.

Example 6

In this example, fifteen layers of fabric F1 of about 38 cm×38 cm (15"×15") were held together by connectors sewn through, and orthogonal to, the fifteen layers. The connector material was 453 dtex (408 denier) cotton thread from United Thread Mills having a force to break of 18.5N. The connector pitch length was 6.4 mm and the connector row spacing was 25.4 mm. The connector lines enclosed a connector area of 645 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 17 grain fragment simulating projectiles (FSP's) against targets supported on an aluminum 24 ga, 0.20, 2024-T3 frame and clamp backing plate. The test articles were arranged in the tests such that the layers having the connectors were facing the projectile. Results of the ballistic tests of three targets gave V50 values of 562 and 589 m/s with an average value of 574 m/s.

Example 7

In this example, fifteen layers of fabric F1 of about 38 cm×38 cm (15"×15") were held together by connectors sewn through, and orthogonal to, the fifteen layers. The connector material was 453 dtex (408 denier) cotton thread from United Thread Mills having a force to break of 18.5N. The connector pitch length was 6.4 mm and the connector row spacing was 6.4 mm. The connector lines enclosed a connector area of 40 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 17 grain fragment simulating projectiles (FSP's) against targets supported on an aluminum 24 ga, 0.20, 2024-T3 frame and clamp backing plate. The test articles were arranged in the tests such that the layers having the connectors were facing the projectile. Results of the ballistic tests of two targets gave V50 values of 571 and 576 m/s with an average value of 574 m/s.

A comparison of the results from Examples 4 to 7 show that the V50 ballistic performance of a fabric assembly in which the connectors enclose an area of about 161 sq. mm. is very good and that enclosed areas of about 363 sq. mm. and about 40 sq. mm. represent the upper and lower limits respectively of enclosed areas that give acceptable ballistic performance.

Example 8

In this example, fifteen layers of fabric F1 of about 38 cm×38 cm (15"×5") were held together by connectors sewn through and orthogonal to the fifteen layers. The connector material was 2400 dtex (2160 denier) cotton thread G4-Tx240 from Saunders Thread Company having a force to break of 40.1N. The connector pitch length was 6.4 mm and the connector row spacing was 12.8 mm. The connector lines enclosed a connector area of 161 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 17 grain FSP's against targets supported on an aluminum 24 ga, 0.20, 2024-T3 frame and clamp backing plate. The test articles were arranged such that the layers having the connectors were facing the projectile. Results of the ballistic tests of four targets gave V50 values between 562 and 576 m/s with an average value of 571 m/s.

Example 9

In this example, fifteen layers of fabric F1 of about 38 cm×38 cm (15"×15") were held together by connectors sewn through and orthogonal to the fifteen layers. The connector material was 453 dtex (408 denier) cotton thread from United Mills having a force to break of 18.5N. The connector pitch length was 6.4 mm and the connector row spacing was 12.8 mm. The connector lines enclosed a connector area of 161 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 17 grain FSP's against targets supported on an aluminum 24 ga, 0.20, 2024-T3 frame and clamp backing plate. The test articles were arranged such that the layers having no connectors were facing the projectile i.e. the layers having the connectors were at the body side. Results of the ballistic tests of four targets gave V50 values between 576 and 590 m/s with an average value of 583 m/s.

This Example shows that an assembly in which the connected fabric layers face away from the strike direction will give an increased V50 when compared to an assembly with no connected layers, provided the connecting material has a force to break of below 65N and the connectors enclose an area of between 50 to 350 sq. mm.

Example 10

In this example, fifteen layers of fabric F1 of about 38 cm×38 cm (15"×15") were held together by connectors sewn through and orthogonal to the fifteen layers. The connector material was 351 dtex (316 denier) Kevlar® thread from United Thread Mills having a force to break of 29N. The connector pitch length was 6.4 mm and the connector row spacing was 12.8 mm. The connector lines enclosed a connector area of 161 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 17 grain FSP's against targets supported on an aluminum 24 ga, 0.20, 2024-T3 frame and clamp backing plate. The test articles were arranged such that the layers having the connectors were facing the projectile. Results of the ballistic tests of four targets gave V50 values between 583 and 594 m/s with an average value of 588 m/s.

Comparison of the results from Examples J, K and 10 shows that the use of a connector material having a low force to break (29N) gives a significantly better V50 compared to use of a connector having a high force to break (69.8N).

Example 11

In this example, fifteen layers of fabric F1 of about 38 cm×38 cm (15"×15") were held together by connectors sewn through the fifteen layers. The connector material was 453 dtex (408 denier) cotton thread from United Mills having a force to break of 18.5N. The connector pitch length was 6.4 mm and the connector row spacing was 12.8 mm. The connector lines enclosed a connector area of 161 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 9 mm 124 grain FMJ bullets against targets supported on a Roma Plastina number 1 clay backing medium. The test articles were arranged such that the layers having no connectors were facing the projectile i.e. the layers having the connectors were at the body side. Results of the ballistic tests of four targets gave V50 values between 465 and 480 m/s with an average value of 473 m/s.

Like Example 9, this example shows that an assembly in which the connected fabric layers face away from the strike direction will give an increased V50 when compared to an assembly with no connected layers, provided the connecting material has a force to break of below 65N and the connectors enclose an area of between 50 to 350 sq. mm.

Example 12

In this example, fifteen layers of fabric F1 of about 38 cm×38 cm (15"×15") were held together by connectors sewn through the fifteen layers. The connector material was 351 dtex (316 denier) Kevlar® thread from United Thread Mills having a force to break of 29N. The connector pitch length was 6.4 mm and the connector row spacing was 12.8 mm. The connector lines enclosed a connector area of 161 sq. mm. The sub-assembly with the connectors was then combined with sixteen loose layers of fabric F1 of about 38 cm×38 cm (15"×15") by corner stitching into an article with an areal density of 4.68 kg/m$^2$. The corner stitching thread was 800 dtex (720 denier) Kevlar® under the tradename B-92 from Imperial Threads Inc. Ballistic tests were conducted using 9 mm 124 grain FMJ bullets against targets supported on a Roma Plastina number 1 clay backing medium. The test articles were arranged such that the layers having no connectors were facing the projectile i.e. the layers having the connectors were at the body side. Results of the ballistic tests of four targets gave V50 values between 492 and 505 m/s with an average value of 498 m/s.

The following table provides a summary of the test results of the examples.

| Ex. Ref. | Fabric Style | # Layers Connected | # Layers Not Connected | Z-Layer Position | Connector Material | Material Grade | Measured Connector Force to Break (N) | Pitch Length (mm) | Row Spacing (mm) | Enclosed Area (sq. mm.) | Total Weight (kg/sq/m.) | Projectile & Backing Plate. | Average V50 (m/s) |
|---|---|---|---|---|---|---|---|---|---|---|---|---|---|
| A | F2 | None | 28 | None | None | None | None | None | None | None | 5.23 | 9 mm & Clay | 488 |
| B | F2 | None | 26 | None | None | None | None | None | None | None | 4.88 | 9 mm & Clay | 483 |
| 1 | F2 | 13 | 13 | Front Side (Facing Bullet) | Cotton | 453 dtex | 18.5 | 6.4 | 12.8 | 161 | 4.88 | 9 mm & Clay | 487 |
| C | F1 | None | 35 | None | None | None | None | None | None | None | 5.28 | 9 mm & Clay | 511 |
| D | F1 | None | 31 | None | None | None | None | None | None | None | 4.68 | 9 mm & Clay | 462 |
| 2 | F1 | 15 | 16 | Front Side (Facing Bullet) | Cotton | 453 dtex | 18.5 | 6.4 | 12.8 | 161 | 4.68 | 9 mm & Clay | 492 |
| 11 | F1 | 15 | 16 | Back Side (Away From Bullet) | Cotton | 453 dtex | 18.5 | 6.4 | 12.8 | 161 | 4.68 | 9 mm & Clay | 473 |

-continued

| Ex. Ref. | Fabric Style | # Layers Connected | # Layers Not Connected | Z-Layer Position | Con-nector Material | Material Grade | Measured Connector Force to Break (N) | Pitch Length (mm) | Row Spacing (mm) | Enclosed Area (sq. mm.) | Total Weight (kg/sq/m.) | Projectile & Backing Plate. | Average V50 (m/s) |
|---|---|---|---|---|---|---|---|---|---|---|---|---|---|
| 12 | F1 | 15 | 16 | Front Side (Facing Bullet) | Kevlar | 351 dtex | 29 | 6.4 | 12.8 | 161 | 4.68 | 9 mm & Clay | 498 |
| E | F2 | None | 28 | None | None | None | None | None | None | None | 5.23 | 17 Grain Frame & Clamp | 577 |
| F | F2 | None | 26 | None | None | None | None | None | None | None | 4.88 | 17 Grain Frame & Clamp | 558 |
| 3 | F2 | 13 | 13 | Front Side (Facing Bullet) | Cotton | 453 dtex | 18.5 | 6.4 | 12.8 | 161 | 4.88 | 17 Grain Frame & Clamp | 569 |
| L | F2 | 26 | None | Front Side (Facing Bullet) | Cotton | 453 dtex | 18.5 | 6.4 | 12.8 | 161 | 4.88 | 17 Grain Frame & Clamp | 518 |
| J | F2 | 13 | 13 | Front Side (Facing Bullet) | Kevlar | 961 dtex | 69.8 | 6.4 | 12.8 | 161 | 4.88 | 17 Grain Frame & Clamp | 547 |
| G | F1 | None | 35 | None | None | None | None | None | None | None | 5.28 | 17 Grain Frame & Clamp | 592 |
| H | F1 | None | 31 | None | None | None | None | None | None | None | 4.68 | 17 Grain Frame & Clamp | 565 |
| K | F1 | 15 | 16 | Front Side (Facing Bullet) | Kevlar | 961 dtex | 69.8 | 6.4 | 12.8 | 161 | 4.68 | 17 Grain Frame & Clamp | 571 |
| 4 | F1 | 15 | 16 | Front Side (Facing Bullet) | Cotton | 453 dtex | 18.5 | 6.4 | 12.8 | 161 | 4.68 | 17 Grain Frame & Clamp | 585 |
| 5 | F1 | 15 | 16 | Front Side (Facing Bullet) | Cotton | 453 dtex | 18.5 | 6.4 | 19.1 | 363 | 4.68 | 17 Grain Frame & Clamp | 564 |
| 6 | F1 | 15 | 16 | Front Side (Facing Bullet) | Cotton | 453 dtex | 18.5 | 6.4 | 25.4 | 645 | 4.68 | 17 Grain Frame & Clamp | 574 |
| 7 | F1 | 15 | 16 | Front Side (Facing Bullet) | Cotton | 453 dtex | 18.5 | 6.4 | 6.4 | 40 | 4.68 | 17 Grain Frame & Clamp | 574 |
| 8 | F1 | 15 | 16 | Front Side (Facing Bullet) | Cotton | 2400 dtex | 40.1 | 6.4 | 12.8 | 161 | 4.68 | 17 Grain Frame & Clamp | 571 |
| 9 | F1 | 15 | 16 | Back Side (Away From Bullet) | Cotton | 453 dtex | 18.5 | 6.4 | 12.8 | 161 | 4.68 | 17 Grain Frame & Clamp | 583 |
| 10 | F1 | 15 | 16 | Front Side (Facing Bullet) | Kevlar | 351 dtex | 29 | 6.4 | 12.8 | 161 | 4.68 | 17 Grain Frame & Clamp | 588 |

What is claimed is:

1. A fabric assembly suitable for resisting a ballistic object comprising:

(a) at least one first section comprising a plurality of connected and compacted fabric layers made from yarn having a tenacity of at least 7.3 grams per dtex and a modulus of at least 100 grams per dtex, wherein the connected and compacted fabric layers are secured together by connectors having a force to break in tension not greater than 65 N, wherein said connectors define areas within and on surfaces of the plurality of fabric layers in a range from 15 to 350 square mm. and wherein compaction of the fabric layers of the first section is at least 2% as set forth in Test Method A and (b) at least one second section comprising a plurality of fabric layers made from yarn having a tenacity of at least 7.3 grams per dtex and a modulus of at least 100 grams per dtex wherein the fabric layers are not connected to define areas in a range from 15 to 350 square mm. and wherein compaction of the fabric layers of the second section is not greater than 0.5% as set forth in Test Method A.

2. The fabric assembly of claim 1 wherein the fabrics of the second section are connected only with sufficient mechanical strength to prevent slippage of the layers relative to one another.

3. The fabric assembly of claim 1 wherein the total number of fabric layers of the first and second sections, when stacked together, have an areal density less than 5.0 kg/m$^2$.

4. A connector of claim 1 in the form of a thread comprising filaments of cotton, polyester, p-aramid, elastomeric polyurethane and mixtures thereof.

5. The fabric of claim 1, wherein the continuous yarns are made of filaments made from a polymer selected from the group consisting of polyamides, polyolefins, polyazoles, and mixtures thereof.

6. A process for making a fabric assembly for a body armor article comprising the steps of:

(a) stacking a plurality of layers of fabric made from continuous yarn having a tenacity of at least 7.3 grams per dtex and a modulus of at least 100 grams per dtex, (b) compacting and securing said plurality of fabric layers to form a first section by inserting connectors through the fabric layers, said connectors forming a pattern of lines on the surface of the fabric, said connectors further having a mechanical strength such that the force to break in tension of each connector is no greater than 65 N wherein said connector lines further define the perimeter of areas of compacted fabric enclosed by the connectors, said enclosed compacted areas being greater than 15 sq. mm. and less than 350 sq. mm. on the compacted fabric layer surfaces, so as to provide a compacted bundle having a compaction of at least 2.0% as set forth in Test Method A (c) stacking a plurality of layers of fabric made from continuous yarn having a tenacity of at least 7.3 grams per dtex and a modulus of at least 100 grams per dtex, (d) forming a second section by securing said plurality of fabric layers at the corners and around the edges so as to provide a cohesive bundle having a compaction not greater than 0.5% as set forth in Test Method A, and (e) combining at least one first section with at least one second section into a fabric assembly having an areal density no greater than 5.0 kg/m$^2$.

* * * * *